United States Patent [19]

Caserza et al.

[11] Patent Number: 4,686,886

[45] Date of Patent: Aug. 18, 1987

[54] DEVICE FOR TEST FIRING OF GUNS WITHOUT AMMUNITION

[75] Inventors: David D. Caserza, San Jose; John W. Russell, Santa Clara, both of Calif.

[73] Assignee: FMC Corporation, Chicago, Ill.

[21] Appl. No.: 708,834

[22] Filed: Mar. 6, 1985

[51] Int. Cl.[4] ..... F41D 11/00

[52] U.S. Cl. ..... 89/11; 73/167

[58] Field of Search ..... 89/11, 1.4; 434/18, 434/24; 73/167

[56] References Cited

U.S. PATENT DOCUMENTS

| | | | |
|---|---|---|---|
| 2,554,714 | 5/1951 | McPherren | 73/167 |
| 2,696,605 | 12/1954 | Knickerbocker | 73/167 |
| 4,050,166 | 9/1977 | Swiatosz et al. | 434/18 |
| 4,301,709 | 11/1981 | Bohorquez et al. | 89/11 |
| 4,481,858 | 11/1984 | Price | 89/11 |

*Primary Examiner*—Frederick R. Schmidt
*Assistant Examiner*—Robert A. Rose
*Attorney, Agent, or Firm*—L. B. Guernsey; H. M. Stanley

[57] ABSTRACT

A device for allowing a 25 mm or similar gun to be cycled through its automatic or semi-automatic mode without live ammunition and without interrupting each cycle because of a misfire. The device is entirely electric and requires no mechanical attachments to the gun and no adjustments of the gun. The device is portable and can be quickly and easily connected to and disconnected from the gun. The device uses signals from a source of gun control signals to develop a sear solenoid voltage which simulates signals developed by gun recoil caused by live ammunition. The simulated signals enable the gun to operate without stopping due to a misfire.

7 Claims, 7 Drawing Figures

DEVICE FOR TEST FIRING OF GUNS WITHOUT AMMUNITION

BACKGROUND OF THE INVENTION

The present invention pertains to a device for testing a gun to be mounted on a vehicle, and more particularly, to a device for operating the gun through one or more complete test cycles without using live ammunition.

Guns which are used on vehicles such as tanks and helicopters may be operated in a semi-automatic mode or in an automatic mode by using a source of gun control signals to cause the guns to operate through a portion of a first cycle of operation and using a gun recoil signal to finish the first cycle and initiate the start of each subsequent cycle. If a gun misfires, operation terminates at the recoil portion of the cycle, so live ammunition should be used when testing a gun to insure that it performs propertly through several cycles of automatic operation. Since it is not always practical to do this at manufacturing facilities, or when troubleshooting a gun system, a modified gun which can go through automatic cycling without using live ammunition and without stopping, can be installed on the vehicle and used to test the control circuitry and ammunition feed system for automatic and semi-automatic operation. When the gun system test is completed with the modified gun, the modified gun is removed and a dedicated gun, which is to remain with the vehicle, is installed for further tests. These further tests include depressing the trigger switch causing the gun to begin a cycle of operation which continues until the gun stops in the misfire mode because a lack of ammunition prevents gun recoil. At this time a misfire switch on the weapon control panel can be depressed allowing the gun to complete its cycle. One difficulty is, that the above procedure tests the electronic control system but does not insure that the dedicated gun can move through the entire cycle using live ammunition, without stopping in the misfire mode. Also using a modified gun for part of the test and a dedicated gun for the remainder of the tests, requires quite a bit of time for mounting and dismounting the guns which makes testing slow and expensive.

SUMMARY OF THE INVENTION

The present invention includes a device for testing a gun in automatic and semi-automatic modes without using live ammunition. In normal operation of the gun a source of gun control signals provides signals which initiate the sequence of loading a round of ammunition into the gun firing chamber and actuating the firing pin. Recoil of the gun is used to cause the gun to continue a cycle through the steps of removing a spent cartridge from the firing chamber and loading another round of ammunition into the firing chamber. If there is no gun recoil, a mechanical stop terminates the sequence of operation and places the gun in a misfire mode with the cartridge still in the chamber. The present invention includes means for developing an electrical signal which performs the same function as the gun recoil and allows the gun to move through several cycles of operation without stopping in a misfire mode and without using live ammunition. Several rounds of dummy ammunition can be fed sequentially into the gun chamber, extracted and discarded in the same manner as live ammunition without a "misfire" interruption of the sequence; or the gun can be operated through several cycles without using any type of ammunition. The device includes a timing circuit which uses a gun control signal to develop an override signal which actuates the mechanical stop and allows the cycle of operation to continue as though gun recoil had taken place.

DESCRIPTION OF THE PREFERRED EMBODIMENT

Figure 1:
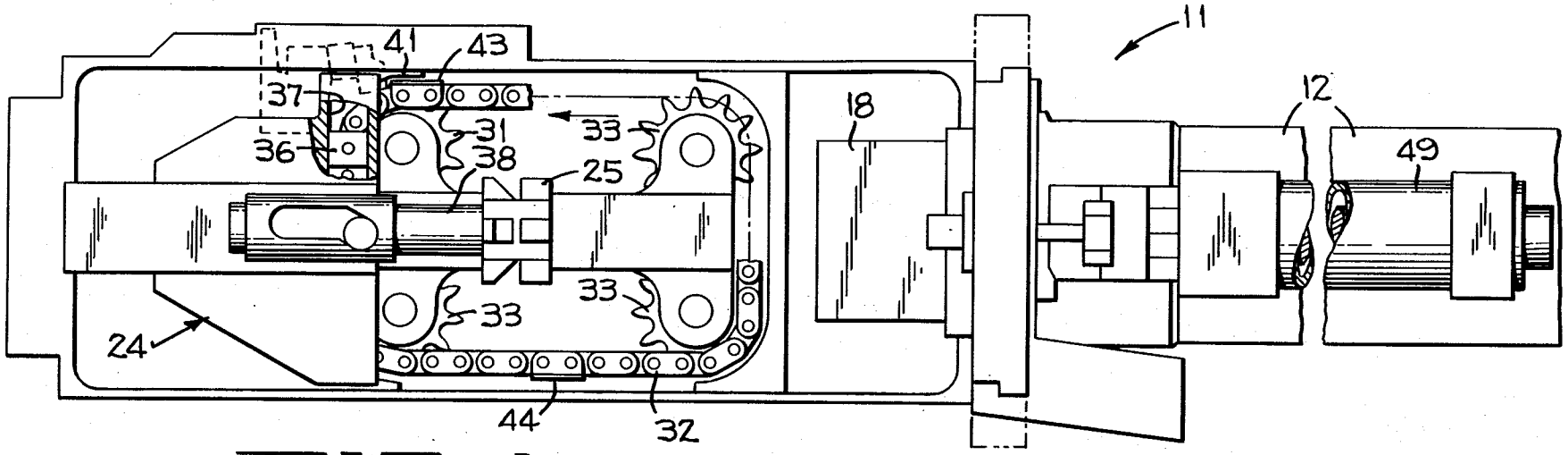
FIG. 1 is a top view of a rapid fire gun showing the apparatus for feeding ammunition to the gun.
Figure 2:
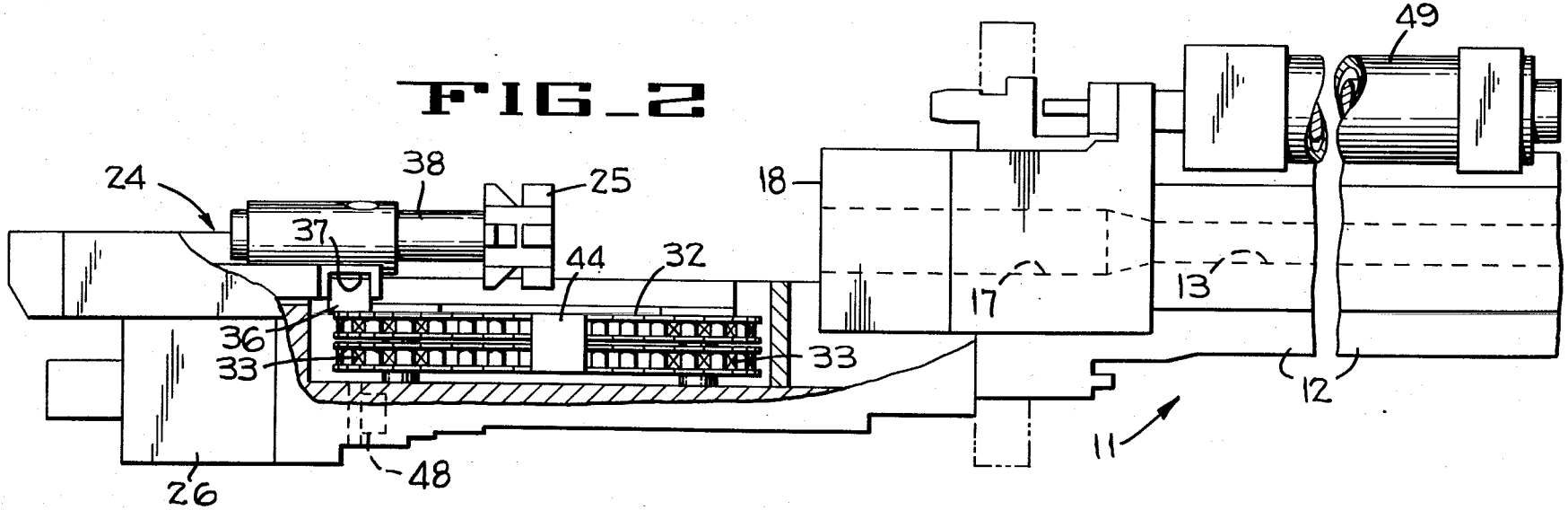
FIG. 2 is a side elevation of the rapid fire gun of FIG. 1 with portions broken away.
Figure 3:
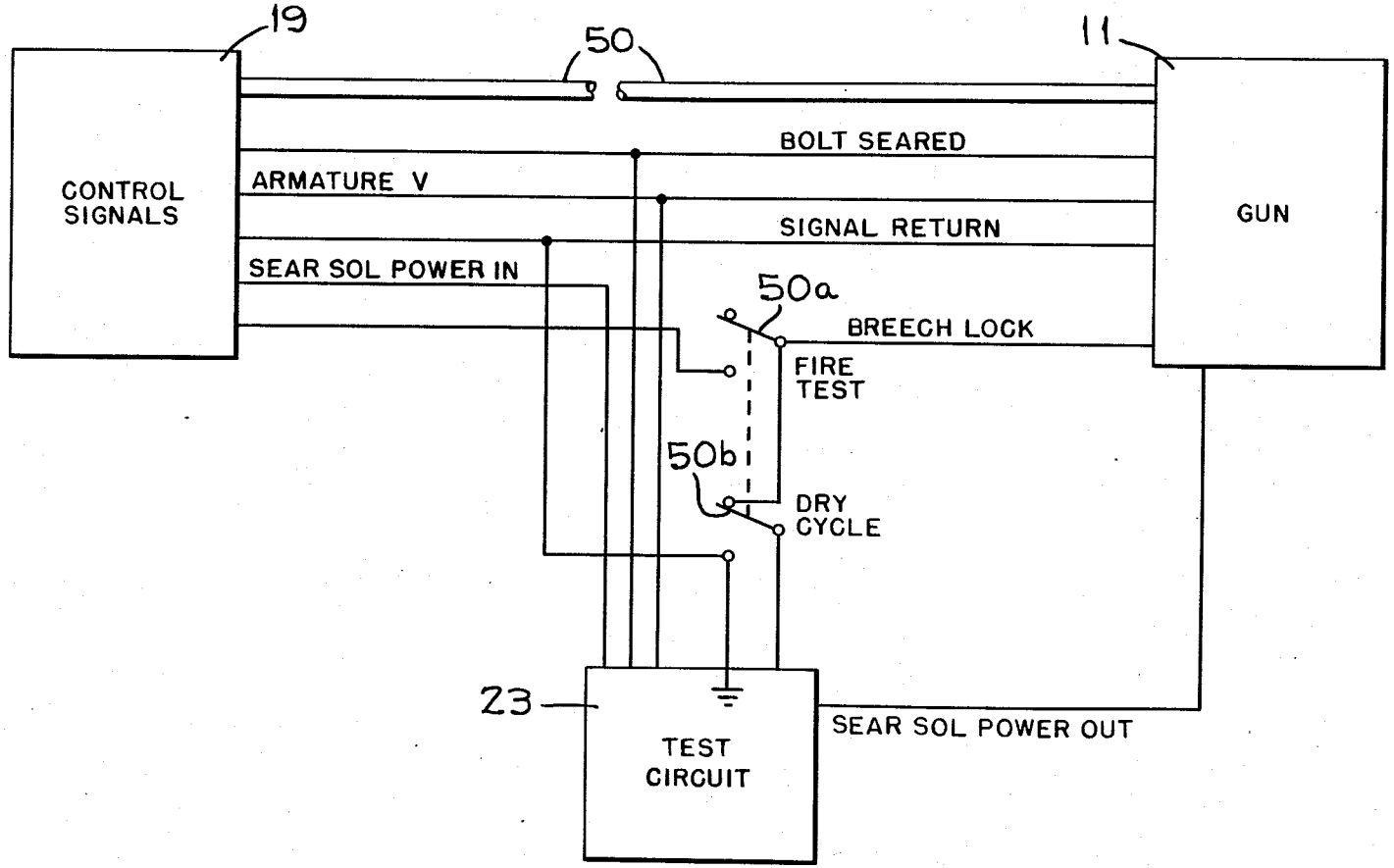
FIG. 3 is a block diagram of a gun control circuit used with the gun of FIG. 1.

The present invention can be used with a rapid fire gun 11 of the type disclosed in FIGS. 1 and 2. Gun 11 includes a barrel 12 having a rifled bore 13 extending lengthwise through the barrel 12 with an enlarged firing chamber 17 at a breech end 18 of the barrel 12. The gun 11 is a chain gun such as the Model M242 manufactured by Hughes Helicopters, Inc., Culver City, Calif. and is capable of operating in automatic and semiautomatic modes. In normal operation the gun 11 (FIG. 3) is connected to a control system 19 which provides external power and operating signals. A test device 23 of the present invention is used only for "dry test" firing of the gun when live ammunition is not used, and this device 23 is disconnected when dry testing is completed. The control system 19 controls triggering of the gun 11; selects the firing mode; selects the rate-of-fire and the type of ammunition to be used in response to inputs from a human operator. The design of the gun 11 and of the control system 19 is not a part of the present invention; however a brief functional description of the gun 11 will be included to aid in understanding the operation of the test device 23 of the present invention.

The gun 11 includes a chain driven bolt and carriage assembly 24 for moving a round of ammunition into the firing chamber 17, locking a bolt 25, dropping a firing pin (not shown) against a primer of the round and ejecting a spent round of ammunition. An electric drive motor 26 (FIG. 2) actuates a drive sprocket 31 (FIG. 1) to move a chain 32 in a counterclockwise direction about a plurality of idler sprockets 33. A slider 36 (FIGS. 1, 2) attached to the chain 32 rides in a channel 37 attached to a bolt carrier 38 to move the bolt 25 toward and away from the breech end of barrel 18 to move rounds of ammunition into the firing chamber 17 and to remove the spent cartridges. A sear pin 41 mounted adjacent the drive wheel 31 (FIG. 1) is extended toward the drive chain 32 by a sear solenoid 48 (FIG. 2) when the sear solenoid 48 is energized. The extended sear pin is moved into position to contact a master link 43 or a safety link 44 and stop movement of the chain 32. If a recoil occurs, due to firing a round, the sear pin 41 is mechanically retracted from the path of the safety link 44 by a recoil mechanism 49 and a mechanical linkage (not shown) and the chain continues to move.

Figure 5:
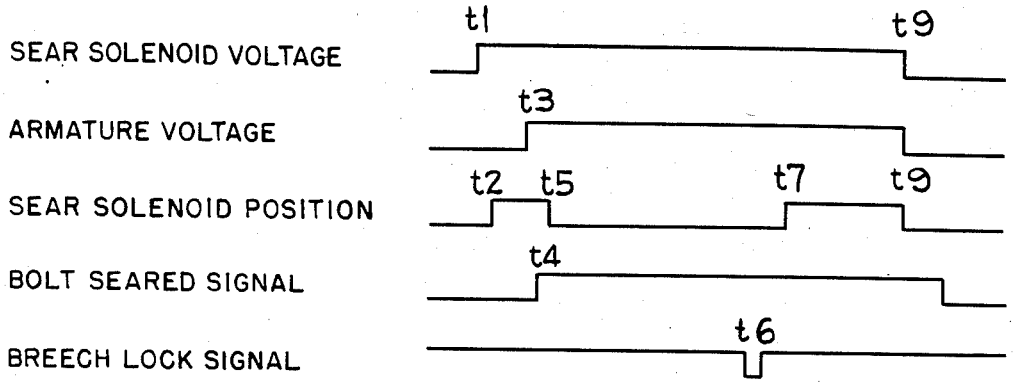
FIG. 5 shows waveforms which illustrate operation of the gun of FIG. 1 when live ammunition is used.

The sequence of gun operation using live ammunition is initiated by pulling the trigger of the gun control system which energizes the sear solenoid by a voltage at a time t1 (FIG. 5) causing the sear to move from an extended position against the chain to a retracted position at a time t2. In the retracted position the chain 32 (FIG. 1) is free to move when the motor armature voltage (FIG. 5) is applied at a time t3. At a time t5 the sear pin is extended into the path of the safety link 44 (FIGS. 1, 2) by a mechanical linkage (not shown) due to movement of the chain 32. At a time t6 (FIG. 5) the gun breech is locked and the gun is fired. At a time t7 gun recoil causes the sear pin 41 (FIG. 1) to be retracted so the safety link 44 can move past the sear pin 41 and not cause the chain movement to stop. At time t9 the sear pin is extended into the path of the master link 43 thereby stopping the chain 32 after one firing cycle has been completed unless the gun control 19 (FIG. 3) is in the automatic firing mode.

Figure 6:
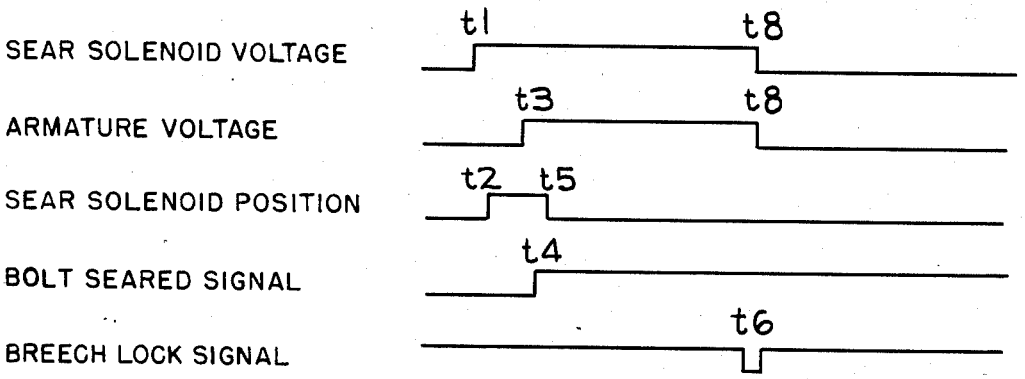
FIG. 6 shows waveforms which illustrate operation of the gun of FIG. 1 when a misfire occurs.

If the gun should misfire or if live ammunition is not used, the sequence of operation is as shown in FIG. 6; the difference in operating being the absence of a recoil which retracted the sear as described in the above firing sequence. Due to the absence of a recoil the sear solenoid and armature voltages are removed, causing the sear pin to remain extended following time t5 (FIG. 6) so the safety link 44 (FIGS. 1, 2) moves into contact with the extended sear pin 44 causing the chain 32 movement to stop and terminating the firing cycle. A human operator must actuate a special misfire switch (not shown) at the control system 19 (FIG. 3) to cause the gun cycle to be completed. The purpose of the safety link 44 is to stop the motion of the chain 32 and keep a live round of ammunition in the firing chamber when a misfire occurs. Otherwise, a live round which misfired when the firing pin dropped, might have a delayed firing after the round is removed from the firing chamber. The purpose of the master link 43 is to stop the motion of the chain at the end of a firing cycle unless control system 19 initiates another cycle of operation.

Figure 4:
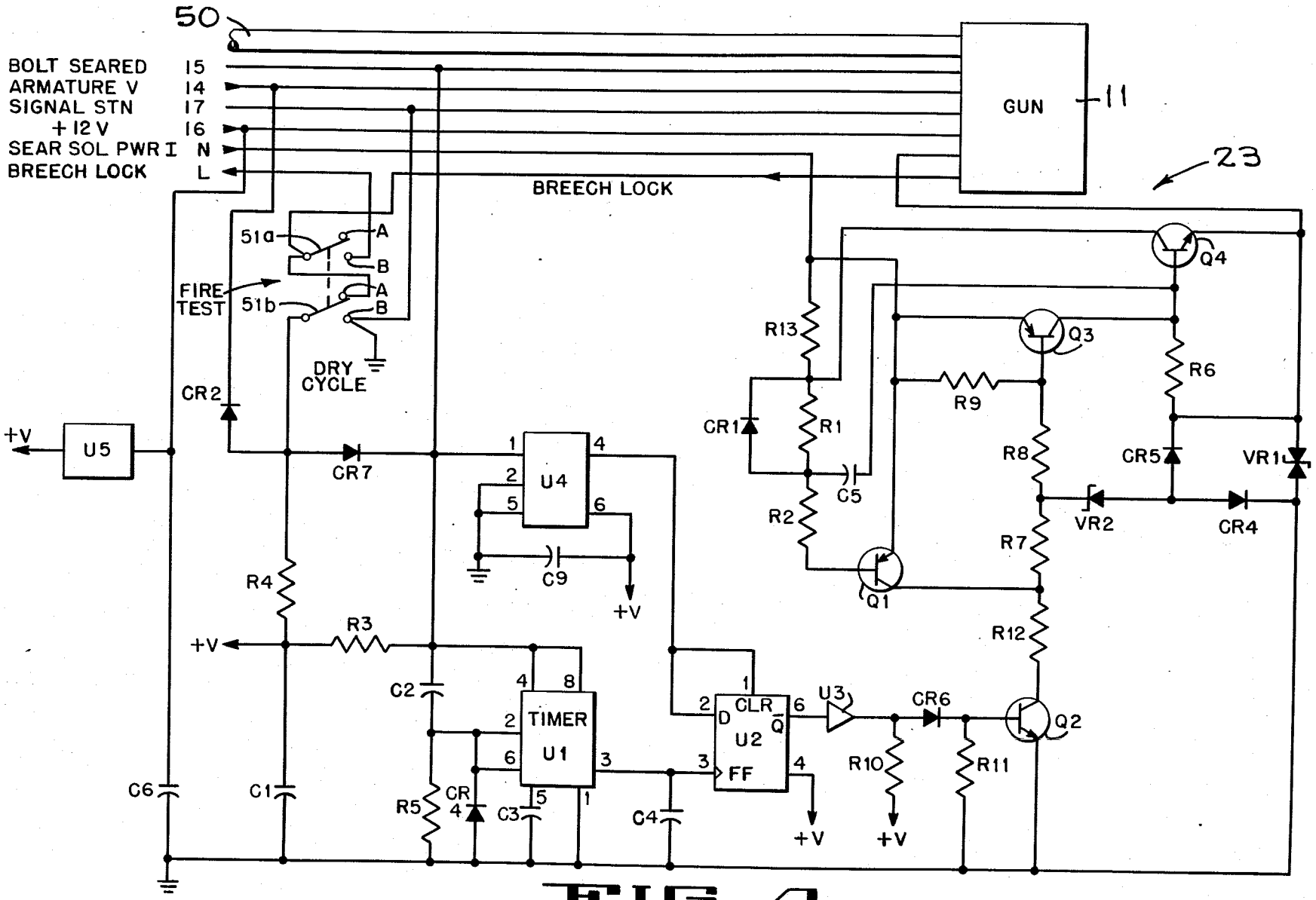
FIG. 4 is a schematic diagram of the test firing device of the present invention.

The test device 23 of the present invention (FIGS. 3, 4) uses the control signals provided by the control system 19 and by the gun 11 (FIG. 3) to provide a signal which replaces the recoil of the gun 11 for retracting the sear pin 41 (FIG. 1) and allows the gun to move through several cycles of operation using dummy ammunition or using no ammunition. The gun control signals which are not needed by the test device 23 are coupled from the control system 19 to the gun 11 (FIGS. 3, 4) by a cable 50 to actuate firing of the gun. When the gun is to be tested through the complete cycle, without live ammunition the switches 51*a*, 51*b* (FIG. 4) are moved up to the "A" contacts into the "test fire" position. The bolt seared signal, the armature voltage, the sear solenoid power input and the gun breech lock signals are coupled to the test device 23 causing the test device 23 to develop the signal which retracts the sear pin at the proper time to allow the safety link to move past the sear pin without any gun recoil.

Figure 7:
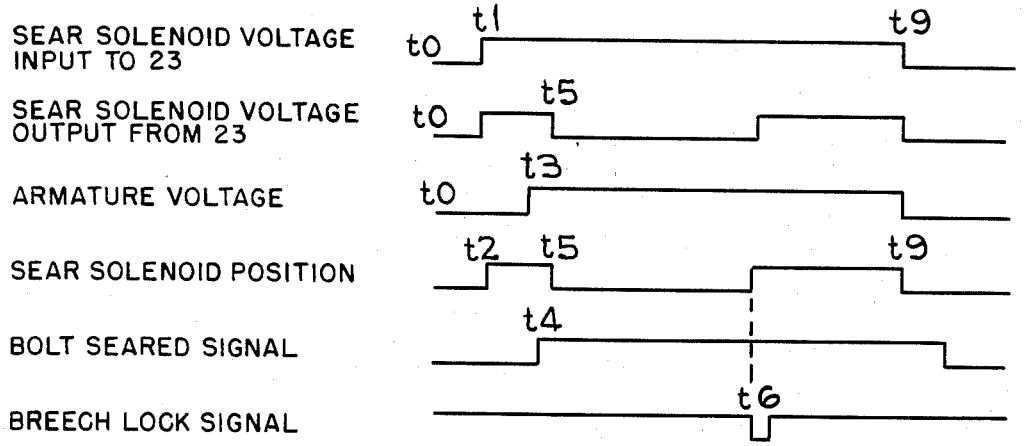
FIG. 7 shows waveforms which illustrate operation of the gun of FIG. 1 when it is used with the test firing circuit of FIG. 4.

At the beginning of the gun cycle t0 (FIG. 7) a low value of armature voltage is coupled through an electro-optical coupler U4 (FIG. 4) to a flip-flop U2 causing the flip-flop to be latched into a state which provides a high output signal through a buffer amplifier U3 to a transistor Q2 rendering transistor Q2 conductive. When transistor Q2 is conductive transistors Q3 and Q4 are rendered conductive so the sear solenoid power input is coupled to the gun 11 at a time t1 (FIG. 7) to the sear solenoid 48 (FIG. 2) causing the sear pin to be retracted at a time t2. With the sear pin retracted away from the master link 43 (FIG. 1) the drive motor 26 is free to move the chain 32 (FIGS. 1, 2) when the armature voltage is applied at a time t3 (FIG. 7). An electrooptical coupler U4 which can be used in the present invention is the Model OPI8012 built by TRW, Inc., Carrollton, Tex. and a flip-flop U2 which can be used is the Model SN 5474 built by Texas Instruments, Dallas, Tex.

At a time t4 (FIG. 7) the bolt seared signal changes to a positive value causing a timer U1 to be activated and to start a timed delay which extends to a time t5. Meanwhile at time t3, the positive armature voltage signal and the positive breech lock signal (from the gun 11) are coupled through the electro-optical coupler U4 to the "clear" and "D" inputs of the flip-flop U2 to disable the clear function of flip-flop U2 and to provide a positive D input voltage.

At time t5 the output of the timer U1 goes high causing the output of the flip-flop U2 to change to a low value. The low output of flip-flop U2 renders transistors Q2, Q3 and Q4 nonconductive. When transistor Q4 is nonconductive the sear solenoid 48 (FIG. 2) is deenergized so the mechanical sear pin is released from a mechanical interlock (not shown). At a time t6 a negative pulse from the breech lock signal (from the gun 11) causes the flip-flop U2 to clear so the output voltage at $\overline{Q}$ goes positive which again causes transistors Q2, Q3 and Q4 to be rendered conductive. Transistor Q4 again provides current which causes the sear pin 41 (FIG. 1) to be retracted and prevents the sear pin from engaging the safety link 44 so the gun cycle is completed without stopping the chain 32. This retraction of the sear pin 41 replaces the mechanical recoil action at time t8 (FIG. 5) which results when live ammunition is used.

When it is desired that the gun be checked for safety by stopping the gun in a misfire position the switches 51*a*, 51*b* (FIG. 4) are moved downward to the "B" position and the gun can be checked in the "dry cycle" mode without disconnecting the test device 23.

Although the best mode contemplated for carrying out the present invention has been herein shown and described, it will be apparent that modification and variation may be made without departing from what is regarded to be the subject matter of the invention.

What is claimed is:

1. A device for controlling the test firing of guns in automatic and semi-automatic modes without using live ammunition, for use with a gun having a mechanical stop for terminating operation when a misfire occurs during a cycle of operation and for use with a source of signals for controlling operation of said gun, said device comprising:

a timing circuit coupled to said signal source for using a gun control signal from said signal source to develop an electrical override signal at a time when gun recoil should occur relative to a firing signal;

means for coupling said timing circuit to said mechanical stop on said gun; and means for using said electrical override signal to actuate said mechanical stop and allow said cycle of operation to continue as though gun recoil had taken place.

2. A device for controlling the test firing of guns as defined in claim 1 wherein said gun includes a sear pin which is mechanically moved into a path of an ammunition feed chain to stop movement of said feed chain when a round of ammunition is fed into a firing chamber, said sear pin preventing further movement of said feed chain until a recoil due to firing said round causes said sear pin to retract from said feed chain path, and wherein said device provides a signal to energize a sear pin solenoid causing said sear pin to be withdrawn from said feed chain path.

3. A device for controlling the test firing of guns as defined in claim 1 including switching means for disabling said override signal for checking the operation of said mechanical stop used in terminating operation when a misfire occurs.

4. A device for controlling the test firing of guns in automatic and semi-automatic modes without using live ammunition, for use with a gun having a mechanical stop for terminating operating of said gun when a misfire occurs during a cycle of operation and for use with a source of signals for controlling operation of said gun, said gun developing a breech lock signal when said breech is locked in a firing position, said device comprising:

a timing circuit coupled to said source of signals for using said breech lock signal to develop an electrical override signal at a time when gun recoil should occur relative to a firing signal;

switching means for coupling said breech lock signal from said gun to said timing circuit when said gun is tested without live ammunition;

means for coupling said timing circuit to said mechanical stop on said gun; and means for using said override signal to actuate said mechanical stop and allow said cycle of operation to continue as though gun recoil had taken place.

5. A device as defined in claim 4 wherein said switching means includes means for selectively disconnecting said breech lock signal from said timing circuit to cause said mechanical stop to terminate operation of said gun when a misfire occurs.

6. A device as defined in claim 1 wherein said override signal causes said gun to operate through a complete cycle of operation without the use of any type of ammunition.

7. A device as defined in claim 4 wherein aid override signal causes said gun to operate through a complete cycle of operation without the use of any type of ammunition.

* * * * *